US011192217B2

(12) United States Patent
Zachariasen

(10) Patent No.: US 11,192,217 B2
(45) Date of Patent: Dec. 7, 2021

(54) TOOL SHARPENER WITH TILTABLE SHARPENING STAGE

(71) Applicant: Darex, LLC, Ashland, OR (US)

(72) Inventor: Joseph T. Zachariasen, Medford, OR (US)

( * ) Notice: Subject to any disclaimer, the term of this patent is extended or adjusted under 35 U.S.C. 154(b) by 0 days.

(21) Appl. No.: 15/929,718

(22) Filed: May 18, 2020

(65) Prior Publication Data

US 2020/0361061 A1 Nov. 19, 2020

Related U.S. Application Data

(60) Provisional application No. 62/849,464, filed on May 17, 2019.

(51) Int. Cl.
*B24D 15/08* (2006.01)

(52) U.S. Cl.
CPC ..... *B24D 15/082* (2013.01)

(58) Field of Classification Search
CPC ..... B24D 15/082
See application file for complete search history.

(56) References Cited

U.S. PATENT DOCUMENTS 1,041,631 A * 10/1912 Johnson ..... B24D 15/081 451/486
1,561,256 A 11/1925 Lilly
2,124,646 A * 7/1938 Barsch ..... B24D 15/081 451/486
2,124,878 A * 7/1938 Hammond ..... B24D 15/081 76/86
2,249,218 A * 7/1941 Meade ..... B24D 15/081 451/486
2,885,836 A * 5/1959 Robitaille ..... B24D 15/081 451/555
4,241,624 A 12/1980 Strojny
4,494,340 A * 1/1985 Carter ..... B24D 15/081 451/555
4,550,632 A * 11/1985 Inman ..... B24D 15/08 451/45
5,009,040 A 4/1991 Petroff
(Continued)

FOREIGN PATENT DOCUMENTS

GB 500678 * 2/1939
GB 517242 * 1/1940

*Primary Examiner* — Hwei-Siu C Payer
(74) *Attorney, Agent, or Firm* — Hall Estill Law Firm

(57) ABSTRACT

Apparatus and method for sharpening a cutting tool, such as but not limited to a knife. A sharpener has a housing with a sharpener stage adapted to facilitate a sharpening operation upon the cutting tool responsive to retraction, by a user, of the cutting tool along a longitudinal drawing axis. A tiltable sharpening mechanism is disposed within the housing adjacent the sharpening stage. The tiltable sharpening mechanism has a central body that is rotatable about a transverse rotational axis nominally orthogonal to the longitudinal drawing axis. The rotatable central body supports at least a first sharpening element. In some cases, the central body supports a pair of intersecting sharpening elements. A biasing member exerts a biasing force to urge the central body of the tiltable sharpening mechanism to a neutral position within the housing. The central body can be locked in neutral, positive rake and negative rake positions.

29 Claims, 6 Drawing Sheets

(56) References Cited

U.S. PATENT DOCUMENTS

| | | | | |
|---|---|---|---|---|
| 5,458,534 | A | 10/1995 | Campione et al. | |
| 5,655,959 | A * | 8/1997 | Juranitch | B24D 15/081 451/486 |
| 6,039,642 | A | 3/2000 | Colllins | |
| 6,101,898 | A | 8/2000 | Gore et al. | |
| D469,326 | S | 1/2003 | Dahms | |
| 6,726,543 | B1 | 4/2004 | Klosterman | |
| 6,875,093 | B2 * | 4/2005 | Friel, Sr. | B24B 3/36 451/260 |
| 7,172,500 | B1 * | 2/2007 | Wu | B24D 15/081 451/319 |
| 8,221,199 | B2 * | 7/2012 | Smith | B24B 3/54 451/552 |
| 8,591,291 | B2 * | 11/2013 | Eklund | B24B 3/546 451/162 |
| 8,944,894 | B2 | 2/2015 | Smith et al. | |
| 9,216,487 | B1 | 12/2015 | Dovel | |
| 10,195,719 | B2 | 2/2019 | Vogel | |
| D860,752 | S | 9/2019 | Bloch | |
| D867,096 | S | 11/2019 | Chalfant et al. | |
| 2006/0211345 | A1 * | 9/2006 | Levsen | B24B 3/40 451/261 |
| 2008/0171504 | A1 | 7/2008 | Smith | |
| 2010/0304646 | A1 | 12/2010 | Lytinas | |
| 2014/0120812 | A1 | 5/2014 | Smith et al. | |
| 2015/0093976 | A1 | 4/2015 | Foster | |
| 2015/0283678 | A1 * | 10/2015 | Hangen | B24D 15/08 451/552 |
| 2020/0361061 | A1 * | 11/2020 | Zachariasen | B24D 15/082 |

* cited by examiner

TOOL SHARPENER WITH TILTABLE SHARPENING STAGE

RELATED APPLICATIONS

The present application makes a claim of domestic priority under 35 U.S.C. 119(e) to U.S. Provisional Patent Application No. 62/849,464 filed May 17, 2019, the contents of which are hereby incorporated by reference.

BACKGROUND

Cutting tools are used in a variety of applications to cut or otherwise remove material from a workpiece. A variety of cutting tools are well known in the art, including but not limited to knives, scissors, shears, blades, chisels, machetes, saws, drill bits, etc.

A cutting tool often has one or more laterally extending, straight or curvilinear cutting edges along which pressure is applied to make a cut. The cutting edge is often defined along the intersection of opposing surfaces (bevels) that intersect along a line that lies along the cutting edge.

In some cutting tools, such as many types of conventional kitchen knives, the opposing surfaces are generally symmetric; other cutting tools, such as many types of scissors and chisels, have a first opposing surface that extends in a substantially normal direction, and a second opposing surface that is skewed with respect to the first surface.

Complex blade geometries can be used, such as multiple sets of bevels at different respective angles that taper to the cutting edge. Scallops or other discontinuous features can also be provided along the cutting edge, such as in the case of serrated knives.

Cutting tools can become dull over time after extended use, and thus it can be desirable to subject a dulled cutting tool to a sharpening operation to restore the cutting edge to a greater level of sharpness. A variety of sharpening techniques are known in the art, including the use of grinding wheels, whet stones, abrasive cloths, abrasive belts, abrasive rods, flexible discs, etc.

SUMMARY

Various embodiments of the present disclosure are generally directed to an apparatus and method for sharpening a cutting tool.

In some embodiments, a sharpener for sharpening a cutting tool includes a housing with a sharpening stage. The sharpening stage is adapted to facilitate a sharpening operation upon the cutting tool responsive to retraction, by a user, of the cutting tool along a longitudinal drawing axis. A tiltable sharpening mechanism is disposed within the housing adjacent the sharpening stage. The tiltable sharpening mechanism includes a central body that is rotatable about a transverse rotational axis nominally orthogonal to the longitudinal drawing axis. The central body supports at least a first sharpening element. A biasing member exerts a biasing force to urge the central body of the tiltable sharpening mechanism to a neutral position within the housing.

In further embodiments, a method is provided for sharpening a cutting tool. The method includes steps of placing a cutting edge into a sharpening stage of a sharpener so that a selected side of the cutting tool contactingly engages a first sharpening element disposed within the sharpening stage; and retracting the cutting tool along a longitudinal drawing axis to slidingly move the selected side of the cutting tool against the first sharpening element. The first sharpening element is configured to rotate within a tiltable sharpening mechanism about a transverse rotational axis nominally orthogonal to the longitudinal drawing axis.

Without limitation, further embodiments incorporate intersecting first and second sharpening elements through which the cutting tool is drawn along the longitudinal drawing axis. A locking mechanism can be used to respectively lock the sharpening element(s) in one or more of a neutral position, a negative rake position and/or a positive rake position.

These and other features and advantages of various embodiments can be understood from a review of the following detailed description in conjunction with the accompanying drawings.

DETAILED DESCRIPTION

Figure 1A:
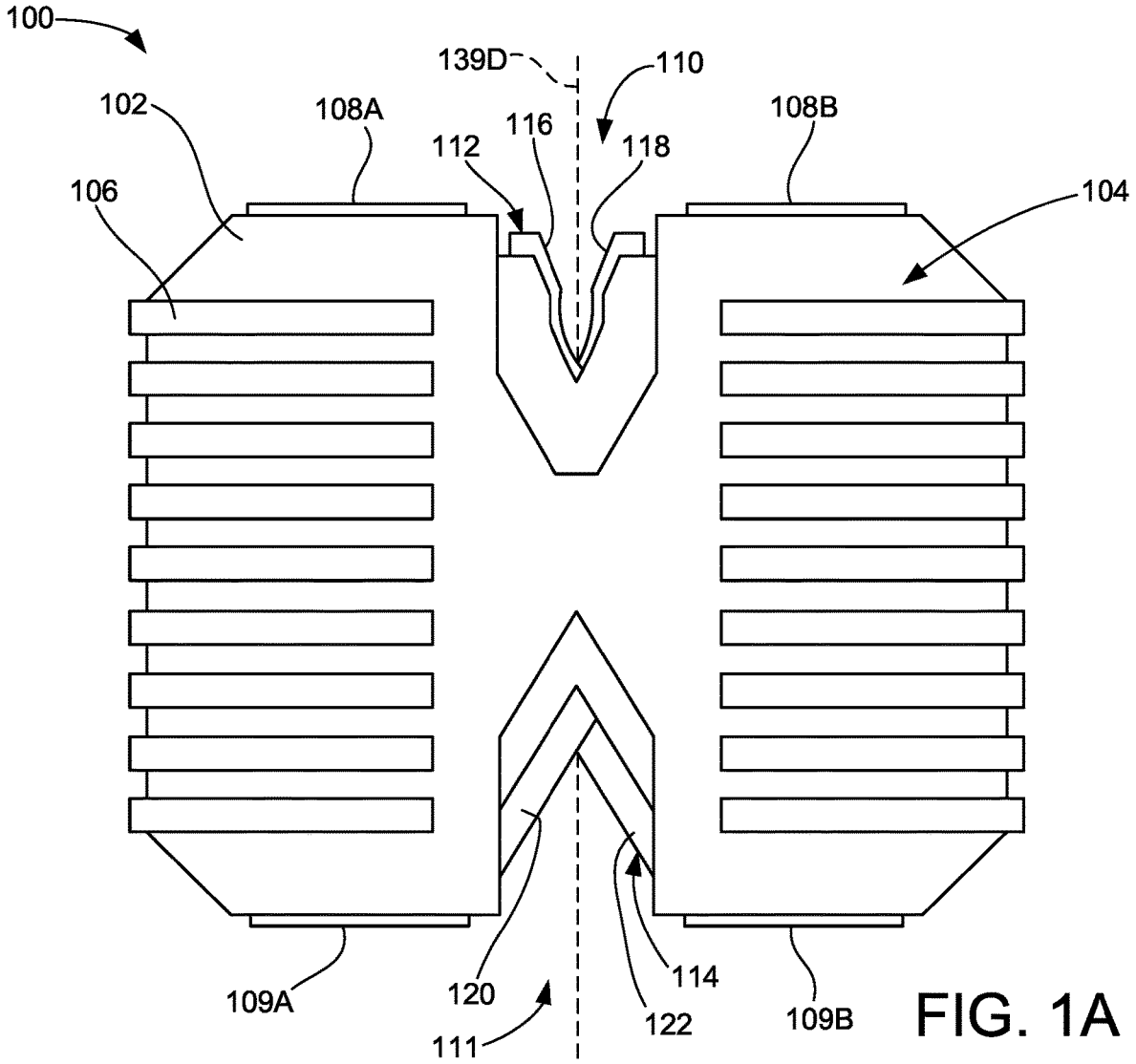
FIGS. 1A and 1B show front and top representations of a manual sharpener constructed and operated in accordance with various embodiments of the present disclosure.

Various embodiments of the present disclosure provide a sharpener for a cutting tool to sharpen a cutting edge thereof, and a method of sharpening the same. The sharpener is adapted to sharpen any number of cutting tool configurations, including but not limited to kitchen knives, pocket knives, etc.

Some embodiments provide a sharpener with a main body (housing) and a tiltable (rotatable) sharpening mechanism housed within the main body. The tiltable sharpening mechanism includes one or more sharpening members (elements) adapted to perform a sharpening operation upon a blade of a cutting tool drawn thereacross. Some embodiments utilize a pair of sharpening elements which intersect along a selected plane.

The sharpening element or elements are supported by a central body of the tiltable sharpening mechanism. The central body is rotatable about a transverse rotational axis that is orthogonal to a longitudinal drawing axis along which the cutting tool is drawn during the sharpening operation;

stated another way, the sharpening element or elements are adapted to rotate, or rock, in a front-to-back orientation with respect to the user as the user retracts the cutting tool against the sharpening element(s).

In some embodiments, the sharpening mechanism includes a single (first) abrasive element. In other embodiments, the sharpening mechanism includes intersecting first and second abrasive elements. The abrasive element(s) can take any number of desired configurations including carbide ripper elements, abrasive ceramic rods, steel elements, diamond or other coated elements, stones, wheels, discs, etc. The abrasive elements can take any suitable shape including linear or curvilinear sharpening surfaces. In some embodiments, the curvilinear surfaces of the abrasive elements are concave in shape in order to impart a convex grinding geometry to the cutting tool.

At least one biasing element, such as a spring, can be affixed to the sharpening mechanism to normally bias the sharpening mechanism, and the intersecting first and second abrasive elements, in a desired normal orientation with respect to a housing of the sharpener. In some embodiments, this orientation is characterized as a zero degree (0°) orientation. A locking mechanism is provided in some embodiments to maintain the first and second abrasive elements in this zero degree orientation. This zero degree orientation is also referred to as a locked neutral position. When the locking mechanism is in place, sharpening operations can be carried out upon the blade of the cutting tool with the first and second abrasive elements in the locked neutral position.

The locking mechanism is configured to selectively release the captured state of the sharpening mechanism so that, if the locking mechanism is in an unlocked state, the sharpening mechanism is free to rotate in response to the drawing of the blade of the cutting tool through the first and second abrasive elements. The total amount of rotation that the sharpening mechanism can undergo is a function of the construction of the sharpener.

In at least some embodiments, it is contemplated that the biasing force supplied by the biasing element will be responsive to the drawing of the blade, and the angle at which the sharpening element(s) engage the blade may change depending on the geometry of the cross section of the cutting tool (e.g., the knife). If the knife bevel geometry does not conform to the shape of the abrasive member, it is considered dull. If a knife is dull, the contact area between the abrasive surface and the knife bevel will be small. This small surface area increases the pressure applied to the knife, assuming the users downward force is constant.

As material continues to be removed from the knife over successive strokes (repetitive retractions of the knife against the sharpening element(s)), the bevel geometry will increasingly conform to the shape of the abrasive element(s), which will in turn reduce the pressure and consequently the amount of material removed from the knife. In this way, the biasing mechanism helps the user remove more material in areas of the knife that are dull, and less material in areas where the knife is sharp or more closely conforms to the contour of the abrasive element. Once the knife geometry nominally conforms to that of the abrasive element(s), the biasing mechanism will not engage with as much force as before, which can serve as a tactile indication to the user that the sharpening operation is completed, or it is time to move to another stage of sharpening to further hone the sharpness of the knife.

In some embodiments, the range of rotation of the sharpening mechanism is limited to an angular range of about nominally +/−15 degrees. When in the unlocked position, retraction of the blade will pull the sharpening elements toward the direction of retraction, increasing the rake angle of the elements upon the blade and enhancing the material removal process. The locking mechanism can be configured to selectively lock or unlock the sharpening mechanism in the neutral position, a positive rake position (e.g., +15 degrees, etc.) and/or a negative rake position (e.g., −15 degrees, etc.). In further embodiments, the tilting mechanism can be respectively locked by the locking mechanism in each of the neutral, positive rake and negative rake positions as desired.

Configuring a sharpener to allow movement of the sharpening mechanism in both positive and negative angular directions will allow both right-handed users and left-handed users to keep the abrasive elements in a positive or negative rake angle depending on the user's perspective. Those skilled in the art will appreciate that some sharpeners of the current art provide fixed abrasive elements that are held in a positive, negative, or neutral rake position in reference to a face of the sharpener, but such sharpeners are limited in that they are most effective in only one orientation. The locking mechanism disclosed here adapts to any orientation, regardless of whether the user is right-handed or left-handed.

Further embodiments can incorporate an additional sharpening element such as in the form of a deployable cone-shaped abrasive rod. The cone-shape abrasive rod may be extendable from and retractable into the housing of the sharpener. The movement can be linear, rotatable, etc. The rod may take a number of configurations including ceramic, diamond coated, etc. Other shapes and styles of extendable and retractable sharpening elements can be used.

The main body (housing) of the sharpener can take a variety of shapes including symmetric, offset, etc. One or more user grip surfaces can be provided to enable a user to hold the sharpener with one hand while retracting the blade through the sharpening mechanism using the other hand. In further embodiments, the sharpener can be configured as a powered sharpener that provides motive power to advance a moveable abrasive member, such as a belt or a disc, adjacent the cutting edge of the tool to carry out a first type of sharpening operation. The powered sharpener can further be configured with a tilting sharpening mechanism to enable the user to carry out a different, second type of sharpening operation upon the tool.

While some embodiments provide concave sharpening elements in the tiltable sharpening mechanism, other embodiments provide a sharpening stage with concave sharpening elements that are stationary with respect to the main body of the sharpener. Hence, while various embodiments provide a sharpener with a tiltable sharpening mechanism, the presence of such tilting capabilities is advantageous but not required. Rather, further embodiments are contemplated that have intersecting sharpening elements with concave sharpening surfaces that do not nominally move with respect to the associated sharpening body.

Figure 1B:
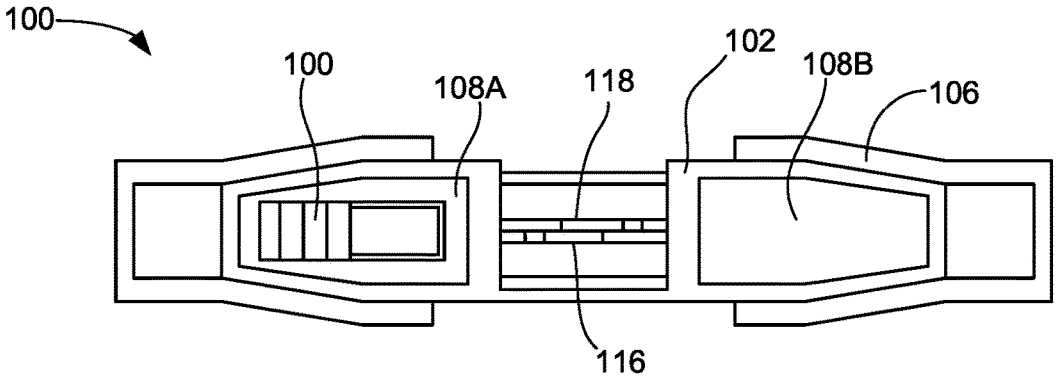

These and other features and advantages of various embodiments can be understood beginning with a review of FIGS. 1A and 1B which show side elevational and top plan views of a manual sharpener 100. The sharpener 100 is a hand-held sharpener configured to be held in the grasp of a user's hand, or to be steadied upright on a base surface, during a sharpening operation upon a cutting tool.

The sharpener includes a rigid housing 102 with a contoured outer grip surface 104 with a series of horizontal ridges 106. The ridges enhance the ability of the user to hold the sharpener in either the left or right hand. Other outer grip surface contours can be used as desired.

The top and bottom surfaces of the sharpener 100 include respective top elastomeric pads 108A, 108B and bottom elastomeric pads 109A, 109B to provide non-skip high friction surfaces to enable either the top or bottom of the sharpener to be placed on an underlying base surface in a secure manner during use.

The sharpener 100 is characterized as a so-called dual-ripper sharpener, so that the housing 102 is provided with a first sharpening stage 110 and a second sharpening stage 111. As explained below, the first sharpening stage 110 is characterized as a tiltable sharpening stage with a tiltable sharpening mechanism 112. The second sharpening stage 111 is characterized as a stationary sharpening stage with a stationary sharpening mechanism 114.

The tiltable sharpening mechanism 112 includes a first pair of intersecting sharpening elements 116, 118 that can be rotated forward and backwards with respect to the housing 102 about a transverse rotational axis over a selected angular range, such as +/−15 degrees. The stationary sharpening mechanism 114 is configured as a rigid mechanism so that a second pair of intersecting sharpening elements 120, 122 remain stationary with respect to the housing 102.

The first elements 116, 118 take a substantially curvilinear configuration and the second elements 120, 122 take a substantially linear configuration, although other arrangements can be used as desired. The elements can take a variety of constructions including tungsten carbide rippers, ceramic rods or other elements, diamond coated elements, steel, etc. Generally, each pair of elements intersect to provide a substantially v-shaped slot with a desired geometry that is generally imparted to the sides of a blade adjacent a cutting edge as the blade is drawn therethrough.

A user-selectable switch 124 is shown to extend along the top left hand side of the sharpener 100 as shown in FIG. 1B. The switch is recessed within the associated pad 108A and can be slid back and forth to lock and unlock the first sharpening mechanism 112, and hence allow or impede angular rotation thereof.

Figure 2A:
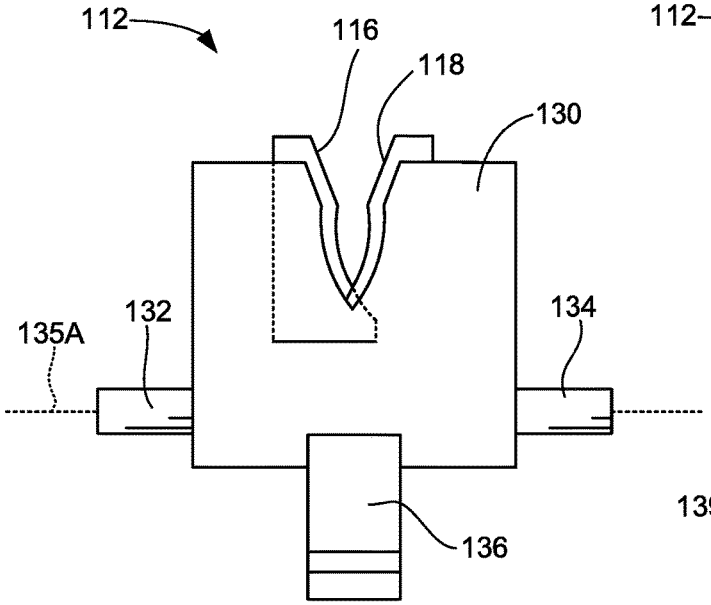
FIGS. 2A and 2B show side front and elevational sides of a tiltable mechanism of the manual sharpener of FIGS. 1A and 1B.
Figure 2B:
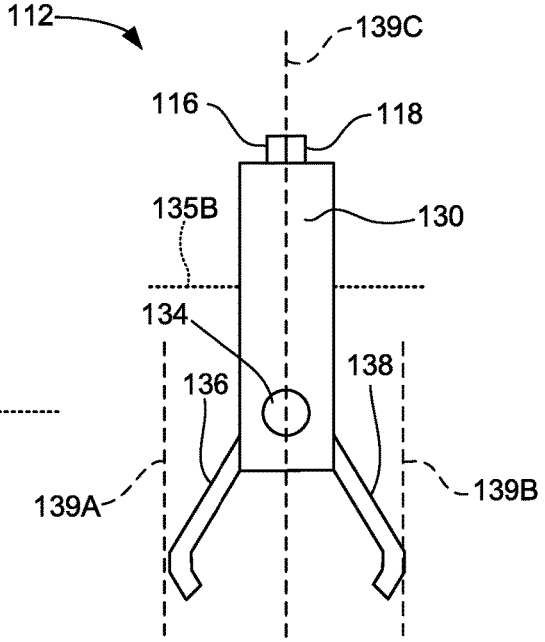

FIGS. 2A and 2B show the tiltable sharpening mechanism 112 of the first sharpening stage 110 in some embodiments. The mechanism 112 includes a rigid body 130 that houses the respective sharpening elements 116, 118. The body 130 is configured to rotate within the housing 102 of the sharpener 100 about a pair of opposing cylindrical shafts 132, 134 which project from opposing sides of the body 130 as shown. The shafts 132, 134 are aligned for rotation about a transverse rotational axis 135A (see FIG. 2A). The transverse rotational axis 135A is nominally orthogonal to a longitudinal drawing axis 135B along which the cutting tool is retracted (drawn) between the sharpening elements 116, 118 during a sharpening operation (see FIG. 2B).

A pair of spring members 136, 138 extend from a lower end of the body 130. The spring members 136, 138 bear against interior wall surfaces 139A, 139B within the housing 102 of the sharpener. In this way, the spring members 136, 138 exert biasing forces that tend to center the sharpening mechanism 112 in an upright position, which corresponds to the aforementioned 0° position, also referred to as the neutral position. For reference, when the mechanism 112 is in the neutral position, a longitudinal axis of the mechanism 139C is nominally parallel to a corresponding longitudinal (e.g., vertical) axis 139D of the housing (see e.g., FIG. 1A).

Figure 3A:
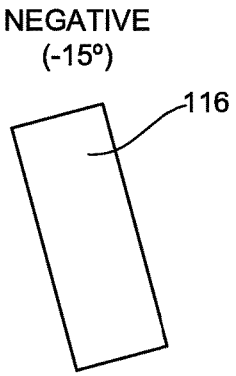
FIGS. 3A through 3C show different tilt angles accomplished by the mechanism of FIGS. 2A and 2B.
Figure 3B:
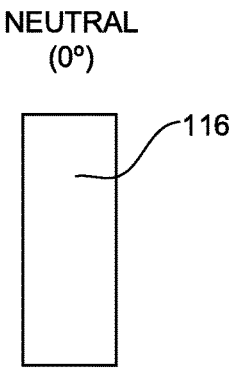
Figure 3C:
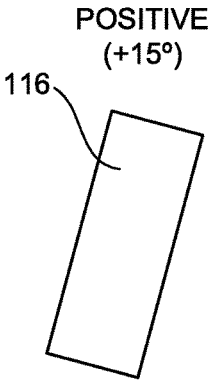

FIGS. 3A through 3C show different orientations of the sharpening mechanism 112 using the first sharpening element 116. It will be appreciated that the second sharpening element 118 concurrently undergoes similar changes in orientation. FIG. 3A shows a negative rake position in which the element 116 is pulled to the left (e.g., in a direction toward the user). FIG. 3B shows the neutral (0°) position, and FIG. 3C shows a positive rake position in which the element 116 is pulled to the right (e.g., oriented in a direction away from the user).

Figure 4A:
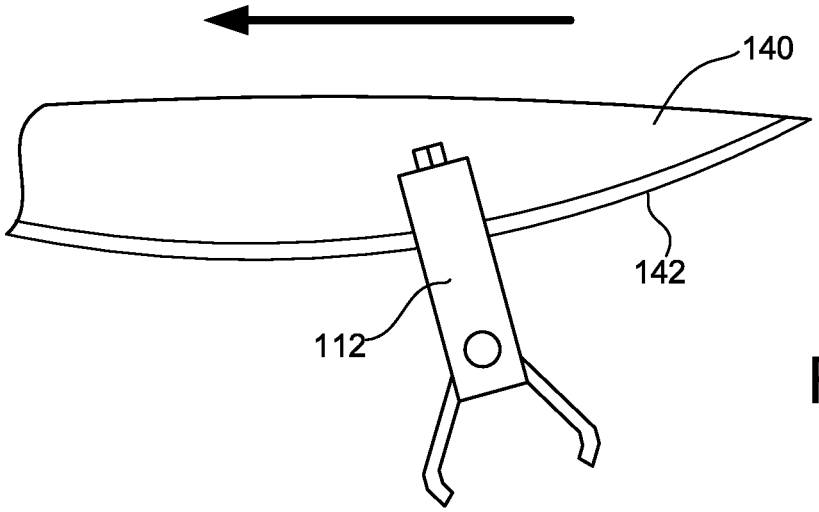
FIGS. 4A through 4C show different angles of the mechanism of FIGS. 2A and 2B in some embodiments.
Figure 4B:
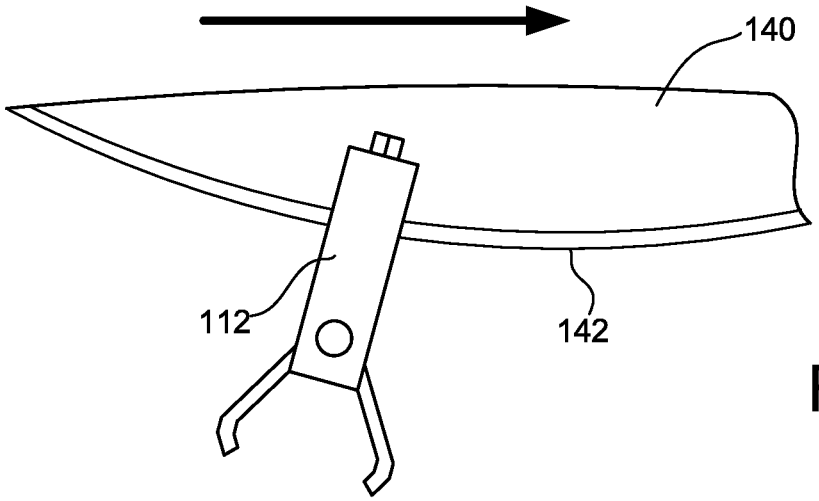
Figure 4C:
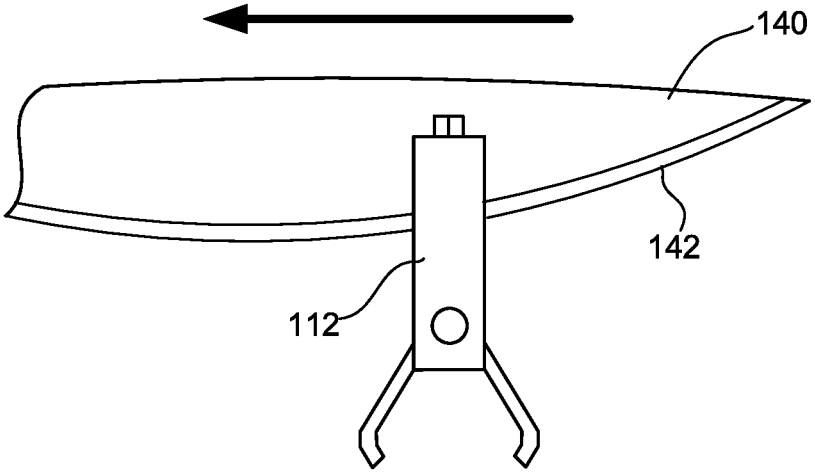

The respective negative and positive positions change the amount of rake, or chisel angle, that can be applied to the blade, thereby enhancing the sharpening efficiency of the elements. These respective angles are depicted in FIGS. 4A through 4C as a blade 140 with cutting edge 142 is respectively pulled through the elements 116, 118 of the sharpening mechanism 112. It can be seen that the sharpener can be used from either direction as required. The sharpening elements 116, 118 can be locked in each of the respective positive rake, neutral and negative rake positions as explained below.

Figure 5:
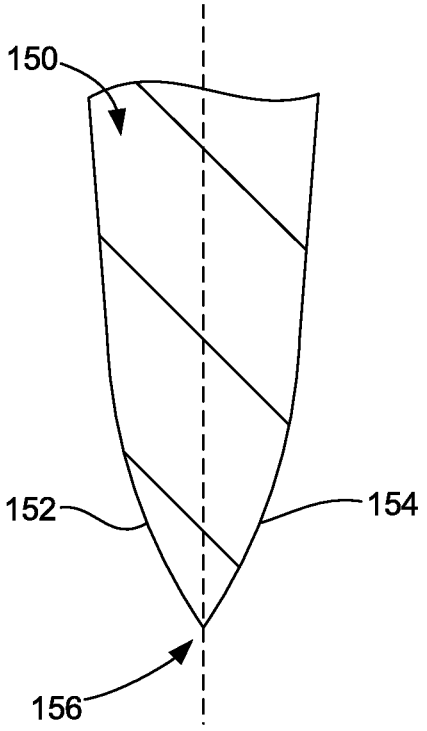
FIG. 5 shows a first sharpening geometry that can be achieved by the sharpener of FIG. 1.

FIG. 5 shows another blade 150 similar to the blade 140. The blade has a convex geometry with curvilinearly extending sides 152, 154 that converge to a cutting edge 156. The convex geometry is formed using the first sharpening mechanism 112, which has corresponding concave shaped curvilinear surfaces on the sharpening elements 116, 118 to generate the convex shape in FIG. 5.

Figure 6:
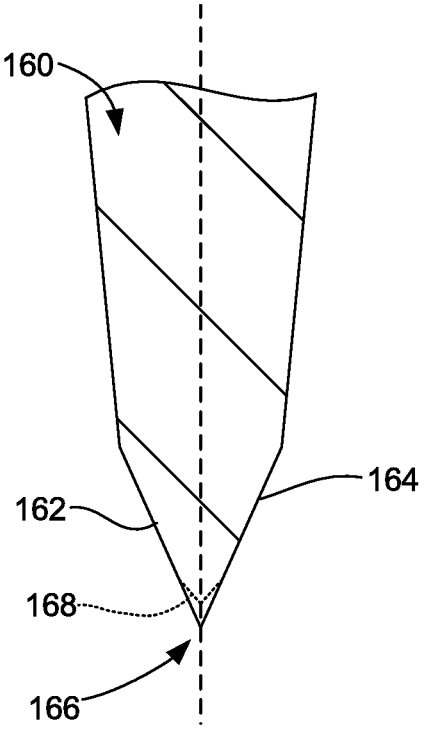
FIG. 6 shows a second sharpening geometry that can be achieved by the sharpener of FIG. 1.

FIG. 6 shows another blade 160. The blade has a linear tapered geometry with flat beveled sides 162, 164 that converge to a cutting edge 166. The linear geometry is formed using the second sharpening mechanism 114, although the linear geometry can also be generated using tiltable elements similar to the elements 116, 118 except with linear (e.g., straight line) sharpening edges.

Multiple sharpening operations can be carried out upon a given blade as desired. For example, a blade can be sharpened during a first sharpening operation using the first sharpening mechanism 112 to provide the general convex geometry of FIG. 5, followed by a second sharpening operation using the second sharpening mechanism 114 to apply a tapered geometry to lower portions of the sides of the blade (e.g., a microbevel) adjacent the cutting edge. In other examples, a blade can be sharpened initially using the first sharpening mechanism 112 in the rotatable state to provide enhanced rake and material take off rate, followed by locking the first sharpening mechanism 112 in the neutral position (or some other position) to provide microbeveling and honing of the cutting edge.

An example microbevel is represented at 168 for the tapered geometry blade 160 in FIG. 6. Similar microbevels can be applied to the convex geometry blade 150 in FIG. 5. Other combinations of the various stages can be used as desired.

Figure 7:
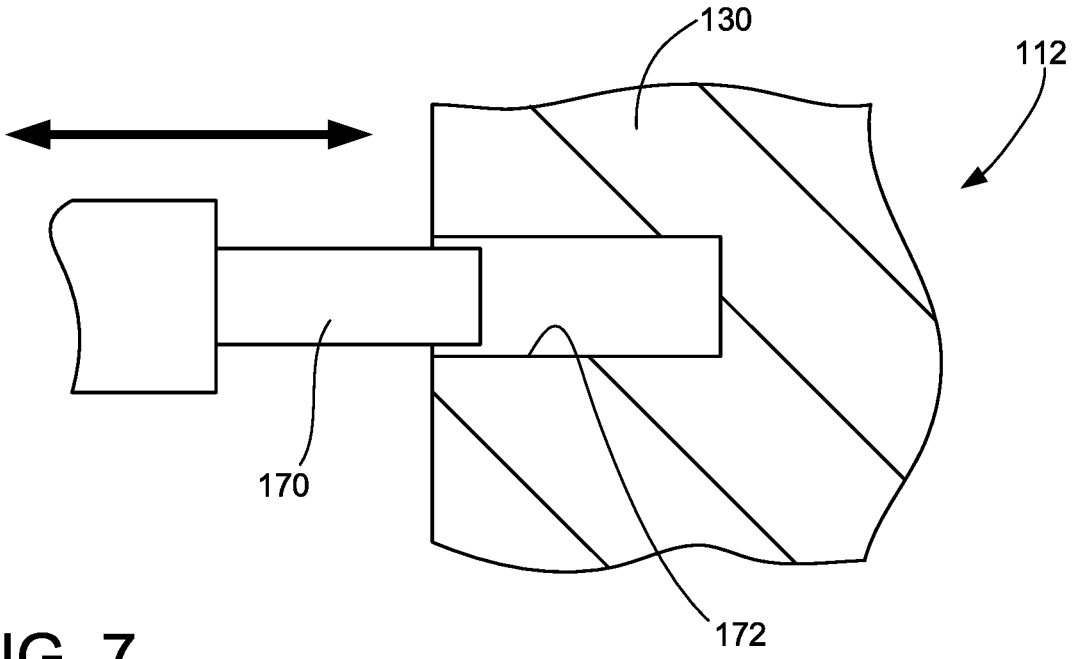
FIG. 7 shows a locking mechanism that can be used with the sharpener of FIG. 1 in some embodiments.

FIG. 7 shows a locking pin 170 adapted to slidingly engage a central locking aperture 172 in the body 130 of the first sharpening mechanism 112. The pin 170 is advanced or retracted using the user selectable switch 124 in FIG. 1B to place the mechanism in the locked or unlocked state. In some embodiments, the pin 170 can be configured to be inserted into the aperture 172 to lock the sharpening mechanism 112 in the neutral position.

The pin 170 can further be extended to one side of the main body of the sharpening mechanism to lock the sharpening mechanism in the positive rake position, and can be extended to the other side of the main body of the sharpening mechanism to lock the sharpening mechanism in the negative rake position. These respective options are denoted in FIGS. 8A through 8C, which show the sharpening mechanism 112 in respective neutral, negative rake and positive rake orientations, respectively.

Figure 8A:
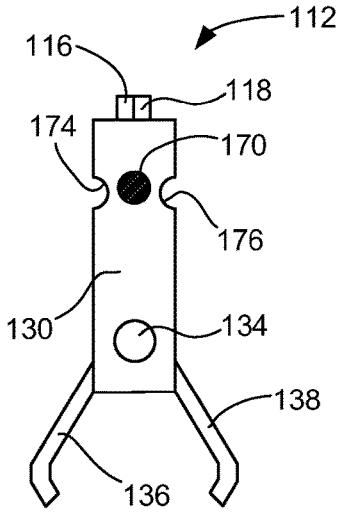
FIGS. 8A through 8C show the locking mechanism of FIG. 7 in accordance with further embodiments.
Figure 8B:
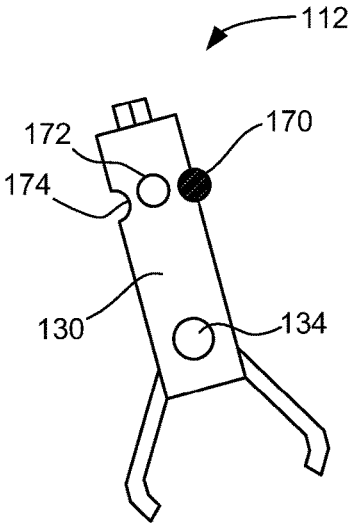
Figure 8C:
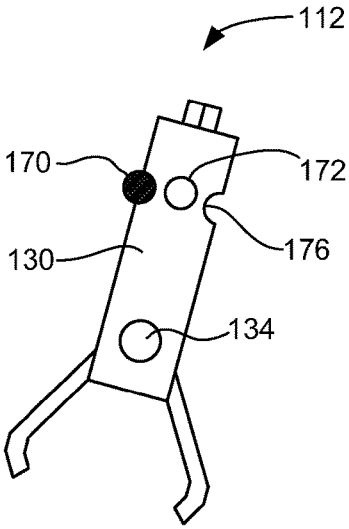

Curvilinearly extending detents 174, 176 can be provided on opposing sides of the central locking aperture 172 to partially receive the extendable and retractable locking pin 170 in the respective central aperture 172 (FIG. 8A), the right-side detent 176 (FIG. 8B) or the left-side detent 174 (FIG. 8C). The use of detents such as 174, 176 are contemplated but not required. As noted above, multi-stage sharpening can be carried out by sequentially locking the mechanism 112 in these respective positions.

For example, one sharpening sequence can involve a first, coarse sharpening operation with the mechanism 112 locked in the negative rack position of FIG. 8B; a second, intermediate sharpening operation with the mechanism 112 locked in the neutral position of FIG. 8A; and a third, fine sharpening operation with the mechanism locked in the positive rake position of FIG. 8C. Other sequences are readily contemplated and will immediately occur to the skilled artisan with the benefit of the present discussion.

Figure 9A:
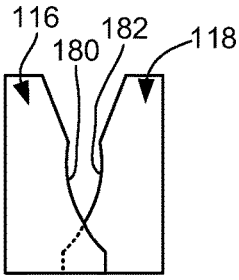
FIGS. 9A through 9D show alternative configurations for the sharpening elements of the tilting mechanism of FIGS. 2A and 2B.

FIGS. 9A through 9D show alternative configurations for the intersecting sharpening elements used in the tiltable sharpening mechanism 112. FIG. 9A shows the elements 116, 118 discussed above with curvilinearly extending sharpening surfaces 180, 182. The surfaces 180, 182 are characterized as concave surfaces to impart a convex sharpening geometry such as depicted in FIG. 5. While FIG. 9A shows the concave surfaces 180, 182 to be implemented in the tiltable sharpening mechanism 112, other arrangements can place the elements in a rigid orientation with respect to a sharpener housing, such as but not limited to the stationary sharpening stage 111 in FIG. 1A. In such case, a sharpener can be configured with concave surfaces to impart convex geometries such as in FIG. 5 without the need for a tiltable mechanism such as provided by the mechanism 112.

Figure 9B:
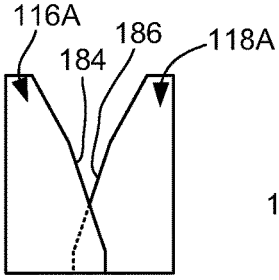

FIG. 9B shows similar sharpening elements 116A, 118A with linearly extending sharpening surfaces 184, 186. The straight surfaces 184, 186 impart a linear beveled geometry such as represented in FIG. 6. In the embodiments of FIGS. 9A and 9B, the respective sharpening elements 116, 116A, 118 and 118A can be metal plates or other members of a suitably hard and durable material.

Figure 9C:
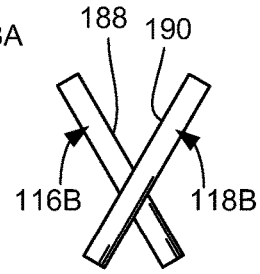

FIG. 9C shows another configuration with sharpening elements 116B, 118B characterized as cylindrical abrasive rods 188, 190. The rods 188, 190 intersect (cross) to form another v-shaped groove through which the blade can be drawn for a sharpening operation. The outer surfaces of the rods 188, 190 are nominally cylindrical (e.g., convex), and will tend to impart a linear beveled geometry as in FIG. 6. By adjusting the angles of the rod front-to-back as in FIGS. 8A-8C, different sharpening angles can be imparted to apply microbeveling to the cutting edge in a manner as discussed above.

Figure 9D:
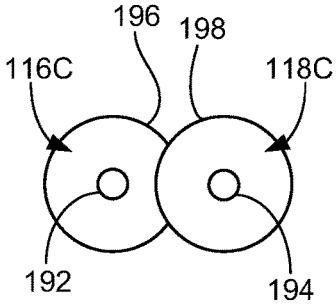

FIG. 9D shows yet another configuration in which sharpening elements 116C, 118C are arranged as interlocking disc shaped abrasive members (e.g., steel washers, etc.). The elements 116C, 118C are each respectively rotatable about central shaft members 192, 194 (e.g., threaded fasteners, etc.). The elements 116C, 118C have convex extending curvilinearly shaped sharpening surfaces 196, 198. In this case, the sharpening elements 116C, 118C are adapted to impart a concave (e.g., hollow grind) geometry to the cutting tool.

As before, the elements (discs) 116C, 118C are coupled to a central body portion that is rotatable about a transverse rotatable axis so that the axes about which the discs rotate (as established by shaft members 192, 194) are in turn rotatable about the transverse rotatable axis. Stated another way, the discs 116C, 118C can be pulled forward about the transverse rotational axis apart from the ability of the discs to be rotated about the rotational axes established by the members 192, 194 (which are generally parallel to the longitudinal drawing axis along which the cutting tool is drawn).

Figure 10:
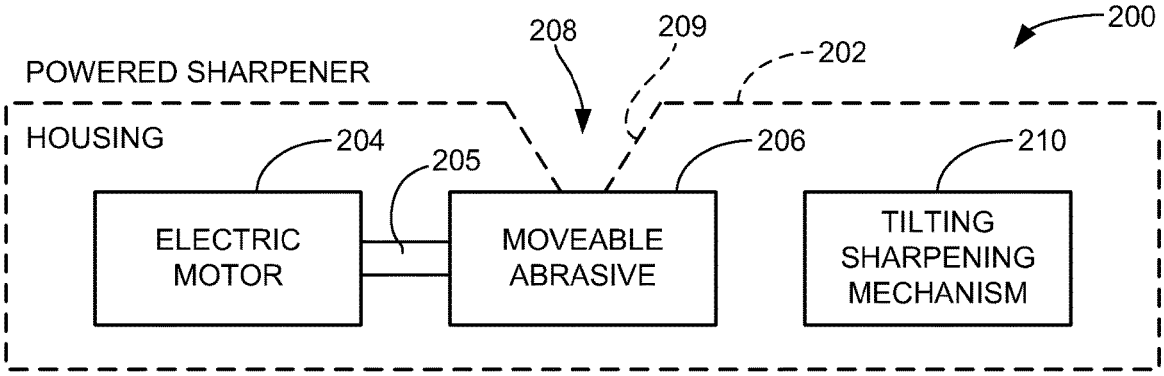
FIG. 10 is a functional block representation of a powered sharpener that incorporates a tiltable sharpening mechanism in accordance with further embodiments.

While the foregoing embodiments have contemplated the tilting mechanism to be incorporated into a manual sharpener, this is merely for purposes of illustration and is not limiting. FIG. 10 is a functional block representation of a powered sharpener 200 constructed and operated in accordance with further embodiments. The powered sharpener 200 includes a main housing 202 which encloses various elements of interest. The housing 202 may be adapted to be supported on a counter or other horizontal base surface during operation, or may incorporate a handle surface adapted to be gripped by a hand of the user to enable the powered sharpener to be used as a hand-held sharpener.

The sharpener 200 includes an electric motor 204 which is adapted to transfer rotational motive power, via a coupling 205 (e.g., a shaft, belt, gearbox, etc.), to a moveable abrasive 206 to advance the abrasive in a desired speed and direction. The motor 204 operates in response to application electrical power from a suitable power source, such as a wall socket, a battery, etc. The abrasive 206 can take any number of suitable forms such as an endless abrasive belt, a rigid grinding wheel, a flexible abrasive disc, etc.

One or more sharpening stages 208 are formed in the housing 202 to enable the user to present the cutting tool against the moveable abrasive 206 at a desired orientation in order to carry out a sharpening operation upon a cutting edge of the tool. The sharpening stage(s) 208 may include one or more support guide surfaces 209 to orient a side of the tool at the desired orientation against the abrasive 206.

The sharpener 200 further includes a tilting sharpening mechanism 210. The tilting sharpening mechanism 210 can take a general form such as the tilting mechanism 112, which has a pair of intersecting sharpening elements such as 116/118, 116A/118A, 116B/118B, 116C/118C, 120/122, etc. The mechanism 210 can provide the user with the option of a number of manual sharpening configurations to augment the sharpening available via the moveable abrasive 206.

In similar fashion, the powered sharpener can include a stationary sharpening stage with curvilinearly extending elements with concave sharpening surfaces, as represented in FIG. 9A, which are secured for non-rotation with respect to the housing 202 to augment the sharpening supplied by the moveable abrasive 206. These and other alternatives are readily contemplated. The angle of the tilting sharpening mechanism 210 (or the alternative stationary mechanism) can be selected to cooperate with the angle imparted by the guide surface(s) 209 to provide a final desired geometry to the cutting tool.

Figure 11A:
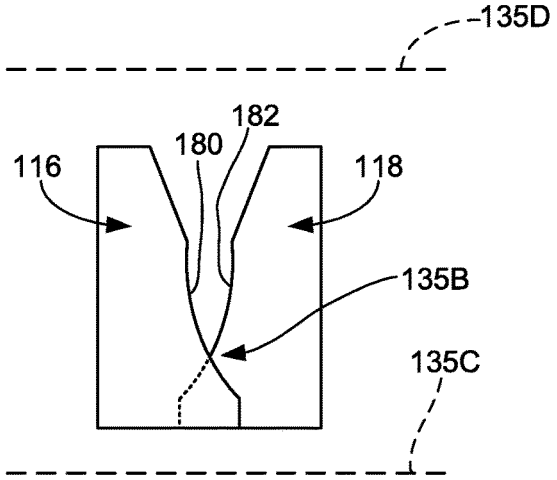
FIGS. 11A and 11B show further configurations of a sharpening mechanism in some embodiments.
Figure 11B:
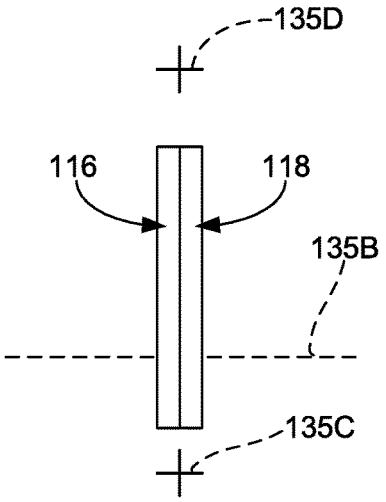

FIGS. 11A and 11B show features of another tiltable sharpening mechanism, numerically denoted with the general reference numeral 210A. The tiltable sharpening mechanism 210A can be incorporated into a manual sharpener such as 100 or a powered sharpener such as 200 as desired. The sharpening mechanism 210A includes intersecting sharpening elements 116, 118 with curvilinear sharpening surfaces 180, 182 as described above. The sharpening elements 116, 118 are supported by a main body (not separately shown) that is rotatable about different transverse axes. One configuration for the main body locates the axis of rotation below the sharpening elements, as indicated by axis 135C. A different configuration for the main body locates the axis of rotation above the sharpening elements, as indicated by axis 135D.

It will be appreciated that if the axis of rotation is below the longitudinal drawing axis along which the blade of the cutting tool is drawn, such as represented by drawing axis 135B and rotational axis 135C, the frictional interaction between the cutting tool and the sharpening elements will tend to induce a negative rake position. Contrawise, if the axis of rotation is above the longitudinal axis, as represented by drawing axis 135B and rotational axis 135D, the frictional interaction will induce a positive rake position. While it is contemplated that the sharpening element(s) will be rotatable about a single axis, further embodiments can include selective orientations of the abrasive elements such that the sharpening element(s) can be rotated about both axes 135C and 135D through user selection.

Figure 12:
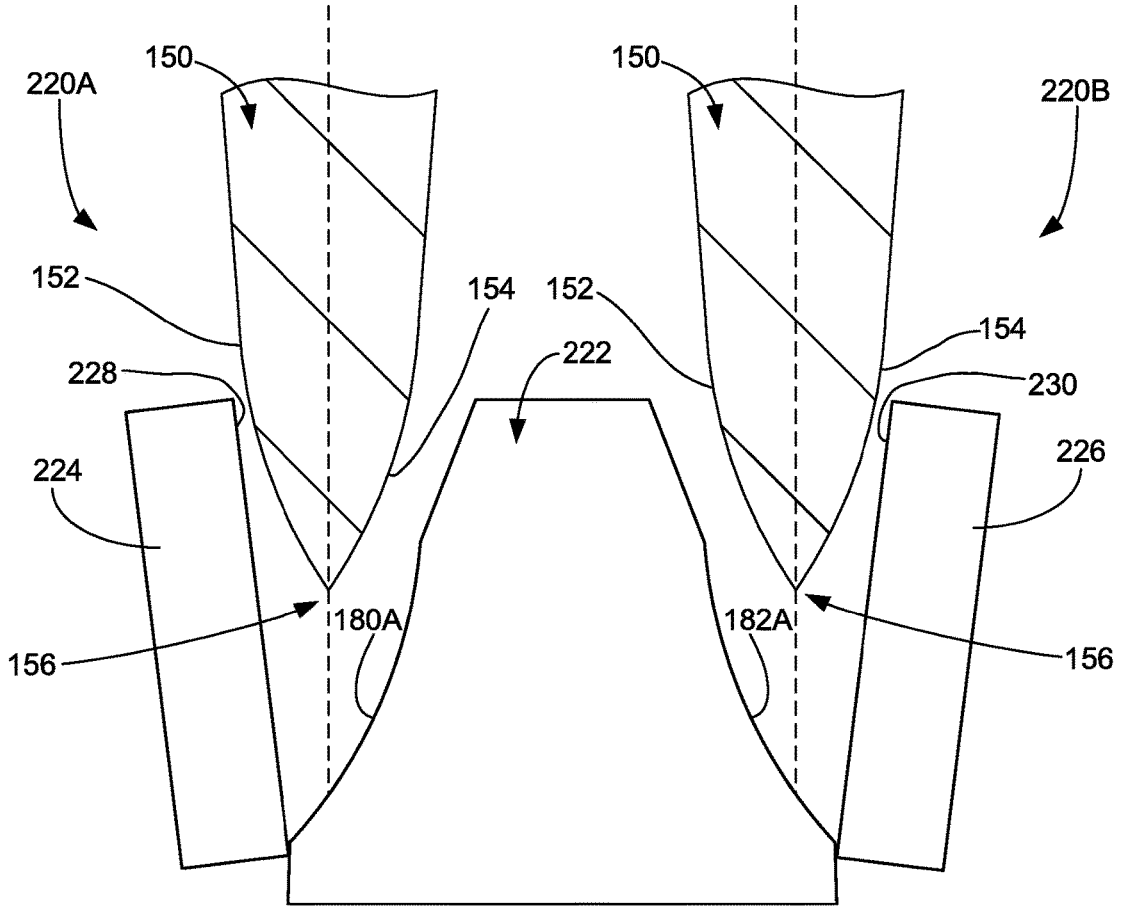
FIG. 12 shows yet another sharpening mechanism in some embodiments.

The various embodiments discussed thus far have contemplated the use of a pair of intersecting sharpening abrasive elements, such as the elements 116 and 118. This is merely for purposes of illustration and is not limiting. In yet further embodiments, a single sharpening element can be utilized, either in a tiltable or stationary orientation with respect to the main housing of the sharpener. To this end, FIG. 12 shows another sharpening system that incorporates two sharpening stages 220A and 22B adapted to sharpen opposing sides of a selected cutting tool. In the present example, the knife 150 from FIG. 5 has been illustrated, although other cutting tools and configurations can be used as desired.

In FIG. 12, the sharpening element 222 includes opposite curvilinearly (e.g., convex) extending sharpening surfaces 180A and 182B. The element 222 is rotatable about a selected transverse rotational axis, such as but not limited to the various axes 135A, 135C or 135D discussed above. In other embodiments, the element 222 is fixed to be stationary with respect to a surrounding housing (e.g., housings 102, 202, etc.).

The element 222 has a general bell shape and is bounded by guide elements 224 and 226, which are disposed in spaced apart relation adjacent opposing sides of the element 222. More particularly, the guide elements 224, 226 have inwardly facing guide surfaces 228, 230 which are in facing relation to the sharpening surfaces 180A, 182A as shown. The guide surfaces operate to maintain the tool 150 in a desired angular orientation as the user draws the tool against the respective sharpening surfaces. More particularly, guide surface 228 contactingly supports side surface 152 of the cutting tool 150 during sharpening of side surface 154, and guide surface 230 contactingly supports side surface 154 of the cutting tool 150 during sharpening of side surface 152.

In this way, the respective sharpening stages 220A and 220B provide separate sharpening stages against which opposing sides of the tool 150 are sharpened in alternating fashion. A user presents the tool 150 into a first stage, such as the stage 220A, and draws the tool therethrough a selected number of times, such as 3-5 times, to remove material and conform the blade to the corresponding shaping surface. The user then repeats this process using the remaining second stage, such as the stage 220B. As before, the sharpening element 222 may be permitted to rotate freely (against the resistance supplied by a biasing element) or may be locked in place in any of a neutral, positive and/or negative rake position. While the sharpening element 222 is shown to be mirrored with dual sharpening surfaces 180A, 180B, in yet another embodiment a single sharpening stage and surface can be provided, so that the user presents the cutting tool from opposite directions to enact the sharpening operation.

It will now be appreciated that the various embodiments presented herein provide a number of benefits over the existing sharpening art. A tiltable sharpening mechanism such as exemplified by the tiltable mechanisms 112, 210 can provide a number of coarse, fine and intermediate sharpening options for a cutting tool. The tiltable mechanism can be used in a stand-alone fashion or in combination with other sharpening stages such as a stationary manual stage as depicted at 114 or a powered stage as provided at 206. In further embodiments, intersecting sharpening elements with concave sharpening surfaces can be provided to impart a convex geometry to a cutting tool. The concave sharpening surfaces can be in a tiltable mechanism (e.g., 112, 210) or a stationary mechanism (e.g., 114). A single sharpening element can be supplied, such as represented by element 222.

It is to be understood that even though numerous characteristics and advantages of various embodiments of the present disclosure have been set forth in the foregoing description, together with details of the structure and function of various embodiments of the disclosure, this detailed description is illustrative only, and changes may be made in detail, especially in matters of structure and arrangements of parts within the principles of the present disclosure to the full extent indicated by the broad general meaning of the terms in which the appended claims are expressed.

What is claimed is:

1. A sharpener for sharpening a cutting tool, the sharpener comprising:

a housing having a sharpening stage adapted to facilitate a sharpening operation upon the cutting tool responsive to retraction, by a user, of the cutting tool along a longitudinal drawing axis; and a tiltable sharpening mechanism disposed within the housing to form a portion of the sharpening stage, the tiltable sharpening mechanism comprising a central body rotatable about a transverse rotational axis nominally orthogonal to the longitudinal drawing axis, the central body supporting a first sharpening element with a sharpening surface adapted to impart a sharpening operation upon a selected side of the cutting tool, the tiltable sharpening mechanism further comprising a biasing member adapted to exert a biasing force to urge the central body of the tiltable sharpening mechanism to a neutral position within the housing, wherein the biasing member comprises opposing first and second spring members each of which exert a centering biasing force upon the central body to maintain the first sharpening element in the neutral position with respect to the housing.

2. The sharpener of claim 1, wherein the longitudinal drawing axis extends in a substantially horizontal direction, and wherein the transverse rotational axis is disposed below the longitudinal drawing axis in a vertical direction orthogonal to the horizontal direction.

3. The sharpener of claim 1, wherein the longitudinal drawing axis extends in a substantially horizontal direction, and wherein the transverse rotational axis is disposed above the longitudinal drawing axis in a vertical direction orthogonal to the horizontal direction.

4. The sharpener of claim 1, wherein the tiltable sharpening mechanism further comprises a pair of opposing shafts about which the central body rotates within the housing, the pair of opposing shafts aligned along the transverse rotational axis.

5. The sharpener of claim 1, further comprising a second sharpening element that intersects the first sharpening element to form a substantially v-shaped groove into which the cutting tool can be inserted during the sharpening operation to contactingly engage the respective first and second sharpening elements.

6. The sharpener of claim 5, wherein each of the first and second sharpening elements has a concave sharpening surface to impart a convex sharpening geometry to a blade of the cutting tool passed therebetween along the longitudinal drawing axis.

7. The sharpener of claim 5, wherein each of the first and second sharpening elements has a convex sharpening surface to impart a concave sharpening geometry to a blade of the cutting tool passed therebetween along the longitudinal drawing axis.

8. The sharpener of claim 5, wherein each of the first and second sharpening elements has a linear sharpening surface to impart a linear sharpening geometry to a blade of the cutting tool passed therebetween along the longitudinal drawing axis.

9. The sharpener of claim 5, wherein each of the first and second sharpening elements has a convex sharpening surface to impart a concave (hollow ground) sharpening geometry to a blade of the cutting tool passed therebetween along the longitudinal drawing axis.

10. The sharpener of claim 1, further comprising a locking mechanism which selectively engages the central body of the tiltable sharpening mechanism to lock the central body in the neutral position.

11. The sharpener of claim 10, wherein the locking mechanism is further configured to selectively engage the central body of the tiltable sharpening mechanism to lock the central body in a negative rake orientation at a selected angle with respect to a first side of a longitudinal axis of the housing.

12. The sharpener of claim 11, wherein the locking mechanism is further configured to selectively engage the central body of the tiltable sharpening mechanism to lock the central body in a positive rake orientation at the selected angle with respect to an opposing second side of the longitudinal axis of the housing.

13. The sharpener of claim 1, wherein the tiltable sharpening mechanism is configured to rotate within the housing over a selected angular range in which the first sharpening element is brought closer to a first side of the housing at one end of the selected angular range and the first sharpening element is brought closer to an opposing second side of the housing at another end of the selected angular range.

14. The sharpener of claim 1, wherein the first sharpening element has a concave sharpening surface to impart a convex sharpening geometry to a blade of the cutting tool passed therebetween along the longitudinal drawing axis.

15. The sharpener of claim 1, further comprising a second sharpening element, wherein each of the first and second sharpening elements has a linear edge to impart a linear beveled sharpening geometry to a blade of the cutting tool passed therebetween along the longitudinal drawing axis.

16. The sharpener of claim 1, wherein the first sharpening element is characterized as a metal plate.

17. The sharpener of claim 1, wherein the first sharpening element is characterized as an abrasive rod.

18. The sharpener of claim 1, wherein the first sharpening element is characterized as a flat abrasive disc rotatable about a disc axis nominally parallel to the longitudinal drawing axis.

19. The sharpener of claim 1, wherein the housing further comprises a stationary sharpening stage comprising a stationary sharpening mechanism with a pair of intersecting sharpening elements configured to perform a sharpening operation upon a blade of the cutting tool passing therebetween, the stationary sharpening mechanism coupled in a stationary, non-moveable relation to the housing.

20. The sharpener of claim 1, further comprising a deployable sharpening element affixed to the housing for selective movement between an extended position and a retracted position.

21. The sharpener of claim 20, wherein the deployable sharpening element is characterized as a cone-shaped abrasive rod.

22. The sharpener of claim 1, further comprising an electric motor disposed within the housing adapted to move a moveable abrasive at a movable abrasive sharpening stage of the housing.

23. A sharpener for sharpening a cutting tool, the sharpener comprising:

a housing;

a sharpening stage adapted to facilitate a sharpening operation upon the cutting tool responsive to retraction, by a user, of the cutting tool along a longitudinal drawing axis, the sharpening stage comprising a tiltable sharpening mechanism disposed within the housing, the tiltable sharpening mechanism comprising a central body rotatable about a transverse rotational axis nominally orthogonal to the longitudinal drawing axis, the central body supporting a first sharpening element with a sharpening surface adapted to impart a sharpening operation upon a selected side of the cutting tool, the tiltable sharpening mechanism further comprising a biasing member adapted to exert a biasing force to urge the central body of the tiltable sharpening mechanism to a neutral position within the housing; and a locking pin which selectively engages the central body of the tiltable sharpening mechanism to lock the central body in the neutral position.

24. The sharpener of claim 23, wherein the biasing member comprises opposing first and second spring members each of which exert a centering biasing force upon the central body to maintain the first sharpening element in the neutral position with respect to the housing.

25. The sharpener of claim 23, wherein the first sharpening element has a concave sharpening surface to impart a convex sharpening geometry to a blade of the cutting tool passed therebetween along the longitudinal drawing axis.

26. A sharpener for sharpening a cutting tool, the sharpener comprising:

a housing; and a sharpening stage adapted to facilitate a sharpening operation upon the cutting tool responsive to retraction, by a user, of the cutting tool along a longitudinal drawing axis, the sharpening stage comprising a tiltable sharpening mechanism disposed within the housing, the tiltable sharpening mechanism comprising a central body rotatable about a transverse rotational axis nominally orthogonal to the longitudinal drawing axis, the central body supporting a first sharpening element with a sharpening surface adapted to impart a sharpening operation upon a selected side of the cutting tool, the tiltable sharpening mechanism further comprising a biasing member adapted to exert a biasing force to urge the central body of the tiltable sharpening mechanism to a neutral position within the housing, wherein the longitudinal drawing axis extends in a substantially horizontal direction, and wherein the transverse rotational axis is disposed above or below the longitudinal drawing axis in a vertical direction orthogonal to the horizontal direction.

27. The sharpener of claim 26, further comprising a locking mechanism configured to respectively lock the central body in the neutral position, in a negative rake position and in a positive rake position.

28. A sharpener for sharpening a cutting tool, the sharpener comprising:

a housing; and a sharpening stage adapted to facilitate a sharpening operation upon the cutting tool responsive to retraction, by a user, of the cutting tool along a longitudinal drawing axis, the sharpening stage comprising a tiltable sharpening mechanism disposed within the housing, the tiltable sharpening mechanism comprising a central body rotatable about a transverse rotational axis nominally orthogonal to the longitudinal drawing axis, the central body supporting a first sharpening element with a sharpening surface adapted to impart a sharpening operation upon a selected side of the cutting tool, the tiltable sharpening mechanism further comprising a biasing member adapted to exert a biasing force to urge the central body of the tiltable sharpening mechanism to a neutral position within the housing, the tiltable sharpening mechanism further comprising a pair of opposing shafts about which the central body rotates within the housing, the pair of opposing shafts aligned along the transverse rotational axis.

29. The sharpener of claim 28, further comprising a locking mechanism which is configured to lock the central body, so as to prevent the central body from rotation within the housing, in each of the neutral position, a negative rake position and a positive rake position.

* * * * *